US008591200B2

(12) United States Patent
Marica

(10) Patent No.: US 8,591,200 B2
(45) Date of Patent: Nov. 26, 2013

(54) HYDRAULICALLY CONTROLLED RECIPROCATING PUMP SYSTEM

(75) Inventor: Adrian Marica, Cypress, TX (US)

(73) Assignee: National Oil Well Varco, L.P., Houston, TX (US)

( * ) Notice: Subject to any disclaimer, the term of this patent is extended or adjusted under 35 U.S.C. 154(b) by 710 days.

(21) Appl. No.: 12/623,951

(22) Filed: Nov. 23, 2009

(65) Prior Publication Data

US 2011/0123363 A1 May 26, 2011

(51) Int. Cl.
*F04B 9/08* (2006.01)

(52) U.S. Cl.
USPC ..... 417/385; 417/388

(58) Field of Classification Search
USPC ..... 417/279, 486, 46, 346, 339, 342, 21, 417/375, 415, 383, 385, 388, 212, 213, 274
See application file for complete search history.

(56) References Cited

U.S. PATENT DOCUMENTS

| | | | | | |
|---|---|---|---|---|---|
| 2,497,300 | A | * | 2/1950 | Elliott | 417/388 |
| 3,289,406 | A | | 12/1966 | Panhard | |
| 4,242,057 | A | | 12/1980 | Bender | |
| 4,269,569 | A | * | 5/1981 | Hoover | 417/5 |
| 4,304,531 | A | * | 12/1981 | Fisher | 417/388 |
| 4,392,784 | A | * | 7/1983 | Hanafi | 417/103 |
| 4,468,174 | A | * | 8/1984 | Pryor | 417/238 |
| 4,470,771 | A | * | 9/1984 | Hall et al. | 417/342 |
| 4,500,267 | A | | 2/1985 | Birdwell | |
| 4,537,562 | A | | 8/1985 | Lindmark et al. | |
| 4,734,011 | A | | 3/1988 | Hall, Jr. | |
| 4,738,595 | A | | 4/1988 | Gaiser | |
| 4,789,313 | A | * | 12/1988 | Tower et al. | 417/388 |
| 4,897,996 | A | | 2/1990 | Hagin et al. | |
| 5,083,430 | A | | 1/1992 | Hirata et al. | |
| 5,249,932 | A | * | 10/1993 | Van Bork | 417/386 |
| 5,337,561 | A | | 8/1994 | Raghavan et al. | |
| 5,630,709 | A | | 5/1997 | Bar-Cohen | |
| 5,662,461 | A | | 9/1997 | Ono | |
| 5,836,400 | A | | 11/1998 | Tupper et al. | |
| 6,371,733 | B1 | | 4/2002 | Renfro | |
| 6,454,542 | B1 | * | 9/2002 | Back | 417/53 |
| 6,554,578 | B1 | * | 4/2003 | Siegel | 417/53 |
| 6,623,254 | B2 | | 9/2003 | Chowaniec et al. | |
| 6,767,189 | B2 | * | 7/2004 | Kleibrink | 417/53 |
| 2003/0021700 | A1 | | 1/2003 | Serafin et al. | |
| 2006/0204375 | A1 | | 9/2006 | Judge et al. | |
| 2006/0228225 | A1 | * | 10/2006 | Rogers | 417/63 |
| 2007/0084357 | A1 | | 4/2007 | Dantlgraber | |
| 2008/0170954 | A1 | | 7/2008 | Jiang et al. | |

FOREIGN PATENT DOCUMENTS

| | | | |
|---|---|---|---|
| DE | 3923529 | A1 | 1/1990 |
| EP | 0393688 | A2 | 10/1990 |
| EP | 0578390 | A1 | 1/1994 |
| WO | 0181761 | A1 | 11/2001 |

* cited by examiner

*Primary Examiner* — Charles Freay
*Assistant Examiner* — Alexander Comley
(74) *Attorney, Agent, or Firm* — Conley Rose, P.C.

(57) ABSTRACT

A system for pressurizing a working fluid includes a cylinder having an outlet through which the working fluid is exhausted at a discharge pressure, a plunger translatably disposed within the cylinder, and a hydraulic system. The plunger has a first piston coupled thereto, a second piston disposed opposite the first piston, wherein the second piston is driven to reciprocate, and a variable-volume chamber disposed between the first and second pistons. The hydraulic system is operable to adjust the volume of hydraulic fluid within the variable-volume chamber, whereby the discharge pressure is maintained substantially at a predetermined level.

16 Claims, 5 Drawing Sheets

HYDRAULICALLY CONTROLLED RECIPROCATING PUMP SYSTEM

CROSS-REFERENCE TO RELATED APPLICATIONS

Not applicable

STATEMENT REGARDING FEDERALLY SPONSORED RESEARCH OR DEVELOPMENT

Not applicable.

BACKGROUND

The disclosure relates generally to systems and methods for reducing pressure pulsations in systems pressurized by a reciprocating pump. More particular, the disclosure relates to a hydraulic system for controlling the discharge pressure of and reducing pressure pulsations in systems pressurized by a triplex reciprocating pump.

To form an oil or gas well, a bottom hole assembly (BHA), including a drill bit, is coupled to a length of drill pipe to form a drill string. The drill string is then inserted downhole, where drilling commences. During drilling, fluid, or "drilling mud," is circulated down through the drill string to lubricate and cool the drill bit as well as to provide a vehicle for removal of drill cuttings from the borehole. After exiting the bit, the drilling fluid returns to the surface through an annulus formed between the drill string and the surrounding borehole wall. Instrumentation for taking various downhole measurements and communication devices are commonly mounted within the drill string. The instrumentation and communication devices operate by sending and receiving pressure pulses through the annular column of drilling fluid maintained in the borehole.

Mud pumps are commonly used to deliver drilling fluid to the drill string during drilling operations. Many conventional mud pumps are of a triplex configuration, having three piston-cylinder assemblies driven out of phase by a common crankshaft and hydraulically coupled between a suction manifold and a discharge manifold. During operation of the mud pump, each piston reciprocates within its associated cylinder. As the piston moves to expand the volume within the cylinder, drilling fluid is drawn from the suction manifold into the cylinder. After the piston reverses direction, the volume within the cylinder decreases and the pressure of drilling fluid contained with the cylinder increases. When the piston reaches the end of its stroke, pressurized drilling fluid is exhausted from the cylinder into the discharge manifold. While the mud pump is operational, this cycle repeats, often at a high cyclic rate, and pressurized drilling fluid is continuously fed to the drill string at a substantially constant rate.

Because each piston within the piston-cylinder assemblies of the mud pump directly contacts drilling fluid within its associated cylinder, loads are transmitted from the piston to the drilling fluid. Due to the reciprocating motion of the piston, the transmitted loads are cyclic, resulting in the creation of pressure pulsations in the drilling fluid. The pressure pulsations disturb the downhole communication devices and instrumentation by degrading the accuracy of measurements taken by the instrumentation and hampering communications between downhole devices and control systems at the surface. Over time, the pressure pulsations may also cause fatigue damage to the drill string pipe and other downhole components.

Accordingly, there is a need for an apparatus or system that reduces pressure pulsations created within fluid pressurized by a reciprocating pump due to contact between the pump piston and the fluid.

SUMMARY

A system including a reciprocating pump and a hydraulic system for controlling the discharge pressure of the pump and reducing pressure pulsations within the pump is disclosed. In some embodiments, the system includes a cylinder having an outlet through which the working fluid is exhausted at a discharge pressure, a plunger translatably disposed within the cylinder, and a hydraulic system. The plunger has a first piston coupled thereto, a second piston disposed opposite the first piston, wherein the second piston is driven to reciprocate, and a variable-volume chamber disposed between the first and second pistons. The variable-volume chamber is substantially filled with a volume of hydraulic fluid. The hydraulic system is operable to adjust the volume of hydraulic fluid within the variable-volume chamber, whereby the discharge pressure is maintained substantially at a predetermined level.

In some embodiments, the system includes a piston-cylinder assembly and a control valve. The piston-cylinder assembly has a cylinder with an outlet through which the working fluid is exhausted at a discharge pressure, two opposing pistons, and a variable-volume chamber disposed between the pistons. The variable-volume chamber is substantially filled with hydraulic fluid. The control valve is fluidicly coupled to the variable-volume chamber and actuatable to relieve hydraulic fluid from the variable-volume chamber when the discharge pressure exceeds a pre-selected pressure and to enable delivery of hydraulic fluid to the variable-volume chamber when the discharge pressure is less than the pre-selected pressure.

In some embodiments, the reciprocating pump includes two opposing pistons, one of the opposing pistons driven to reciprocate, a variable-volume chamber disposed between the opposing pistons and containing hydraulic fluid, a control valve fluidicly coupled to the variable-volume chamber, and a transducer coupled between the opposing pistons. The control valve is actuatable to relieve hydraulic fluid from the variable-volume chamber when the discharge pressure exceeds a pre-selected pressure and to enable delivery of hydraulic fluid to the variable-volume chamber when the discharge pressure is less than the pre-selected pressure. The transducer is operable to monitor a relative position of the opposing pistons and to modify the pre-selected value.

Thus, embodiments described herein comprise a combination of features and characteristics intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
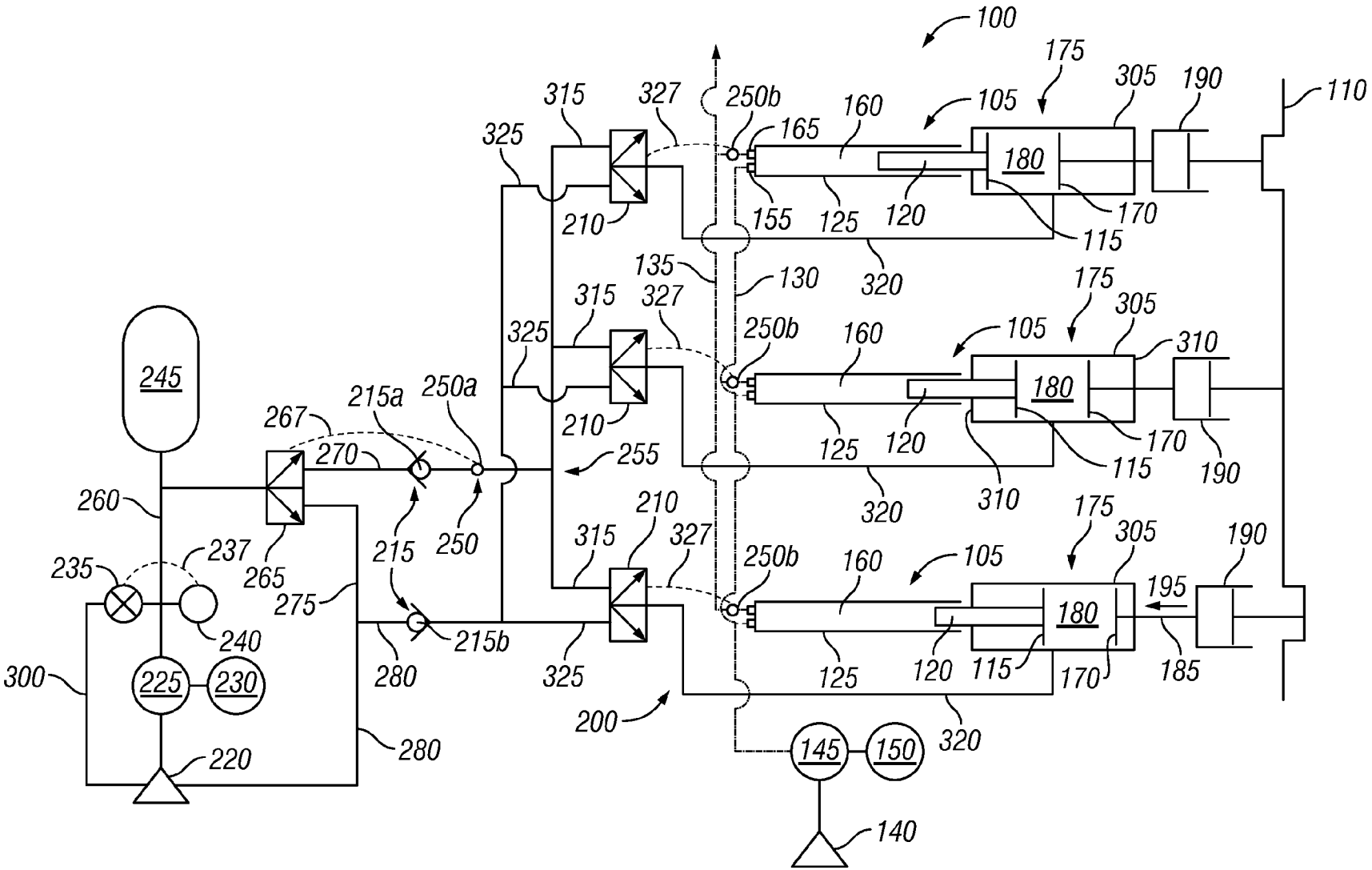
FIG. 1 is a schematic representation of a reciprocating pump system including a hydraulic control system in accordance with the principles disclosed herein, wherein a piston disposed within each piston-cylinder assembly of the pump system displaces under hydraulic pressure.

The following description is directed to exemplary embodiments of a hydraulically controlled, mechanically driven reciprocating pump system. The embodiments disclosed should not be interpreted, or otherwise used, as limiting the scope of the disclosure, including the claims. One skilled in the art will understand that the following description has broad application, and that the discussion is meant only to be exemplary of the described embodiments, and not intended to suggest that the scope of the disclosure, including the claims, is limited only to those embodiments. For example, the apparatus described herein may be employed in any fluid conveyance system where it is desirable to reduce the turbulence of fluid contained within or moving through the system.

Certain terms are used throughout the following description and the claims to refer to particular features or components. As one skilled in the art will appreciate, different persons may refer to the same feature or component by different names. This document does not intend to distinguish between components or features that differ in name but not function. Moreover, the drawing figures are not necessarily to scale. Certain features and components described herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, the connection between the first device and the second device may be through a direct connection, or through an indirect connection via other intermediate devices and connections. Further, the terms "axial" and "axially" generally mean along or parallel to a central or longitudinal axis.

Referring now to FIG. 1, there is shown a reciprocating pump system 100 for pressurizing a working fluid, such as but not limited to drilling mud. Reciprocating pump system 100 includes three substantially identical piston-cylinder assemblies 105 driven by a common crankshaft 110. Each piston-cylinder assembly 105 includes a piston 115 coupled to a plunger 120 translatably disposed within a cylinder 125. Each piston 115 is also coupled to crankshaft 110, as will be described, such that piston-cylinder assemblies 105 are driven out of phase with each other, meaning the position of each plunger 120 within its associated cylinder 125 is different than that of the other plungers 120 at any given instant. For example, as shown, plunger 120 of the uppermost piston-cylinder assembly 105 is fully stroked out within its cylinder 125, plunger 120 of the lowermost piston-cylinder assembly 105 is fully stroked back, and plunger 120 of the center piston-cylinder assembly 105 is substantially midway between the fully stroked out and back positions. In the embodiments described herein, piston-cylinder assemblies 105 are operated 120 degrees out of phase with each other, but other phase relationships may also be employed.

Each piston-cylinder assembly 105 is coupled between a suction manifold 130 and a discharge manifold 135. Drilling mud is delivered from a source 140 via a pump 145 driven by a motor 150 through suction manifold 130 to each cylinder 125. As each plunger 120 is stroked back by crankshaft 110, drilling mud is drawn through a suction valve 155 into a compression chamber 160 within cylinder 125. After plunger 120 reverses direction, drilling mud contained within compression chamber 160 is pressurized by plunger 120. When plunger 120 approaches the end of its stroke, the pressurized drilling mud is exhausted from cylinder 125 through a discharge valve 165 into discharge manifold 130. Thus, as crankshaft 110 rotates, piston-cylinders 105 repeatedly receive drilling mud from suction manifold 130, pressurize the drilling mud received, and deliver the pressurized drilling mud to discharge manifold 135.

Each piston 115 is coupled to crankshaft 110 by an opposing piston 170, a sealed variable-volume chamber 175 of hydraulic fluid 180 disposed between opposing pistons 115, 170, and a connecting rod 185. Connecting rod 185 is coupled by a sliding joint 190 to crankshaft 110. Sliding joint 190 enables the transmission of load from crankshaft 110 to connecting rod 185 in a direction 195 substantially parallel to connecting rod 185, but absorbs load from crankshaft 110 in other directions. During conditions when a variable-volume chamber 175 is substantially full of hydraulic fluid 180 and the pressure of that fluid remains substantially constant, e.g., no fluid is permitted to leave variable-volume chamber 175, all mechanical load from crankshaft 110 transferred through sliding joint 190 and connecting rod 185 to piston 170 is also transferred from piston 170 to piston 115 via hydraulic fluid 180, whereby piston 115 reciprocates in unison with piston 170.

To reduce pressure pulsations created in the drilling mud received within cylinders 125 of piston-cylinder assemblies 105 due to contact with pistons 115, reciprocating piston system 100 further includes a hydraulic control system 200 coupled between each pair of opposing pistons 115, 170. As will be described, hydraulic control system 200 enables the delivery of pressurized drilling mud from each piston-cylinder assembly 105 with reduced pressure pulsations, as compared to those created within a piston-cylinder assembly of a conventional reciprocating pump having no hydraulic control system. In the embodiment of FIG. 1, reciprocating pump system 100 is mechanically driven by crankshaft 110, but hydraulically controlled by system 200.

Hydraulic system 200 includes variable-volume chambers 175, hydraulic cylinders 305 within which pistons 115,170 and variable-volume chambers 175 are disposed, proportional pressure control (PPC) valves 210, 265, and one or more one-way check valves 215, all fluidicly coupled by a piping network 255. As used herein, the term "fluidicly coupled" means in fluid communication. Thus, variable-volume chambers 175, hydraulic cylinders 305, control valves 210, 265, and check valves 215 are in fluid communication via piping network 255. Also as defined herein, piping network 255 refers to the plurality of hydraulic fluid flowlines coupled between PPC valve 265 and hydraulic cylinders 305 to supply hydraulic fluid 180 from PPC valve 265 to variable-volume chambers 175. Piping network 255 includes flowline 270 coupled to PPC valve 265, flowlines 315 coupled between flowline 270 and PPC valves 210, and flowlines 320 coupled between PPC valves 210 and variable-volume chambers 175, all described in more detail below.

Reciprocating pump system 100 further includes a plurality of sensors 250. In the embodiment shown in FIG. 1, sensors 250 are high pressure sensors, such those having model number P5000-500-1G3S and manufactured by Kavlico, Inc., headquartered at 14501 Princeton Avenue, Moorpark, Calif. 93021. Moreover, in the embodiment shown in FIG. 1, valves 210, 265 are electro-proportional reducing/relieving pressure control valves, such as those having model number EHPR98-T38 and manufactured by HydraForce, Inc., headquartered at 500 Barclay Blvd., Lincolnshire, Ill. 60069.

For supplying hydraulic fluid 180 to and relieving hydraulic fluid 180 from piping network 255, hydraulic control system 200 further includes a hydraulic fluid source 220, a pump 225 driven by a motor 230, a relief valve 235 and gauge 240, and an accumulator 245, all fluidicly coupled to piping network 255 by flowlines 260, 280. When motor 230 is operating, source pump 225 delivers hydraulic fluid 180 from source 220 through flowline 260 to PPC valve 265. Hydraulic fluid 180 relieved from piping network 255, as will be described, is returned to hydraulic fluid source 220 through flowline 280.

Figure 2:
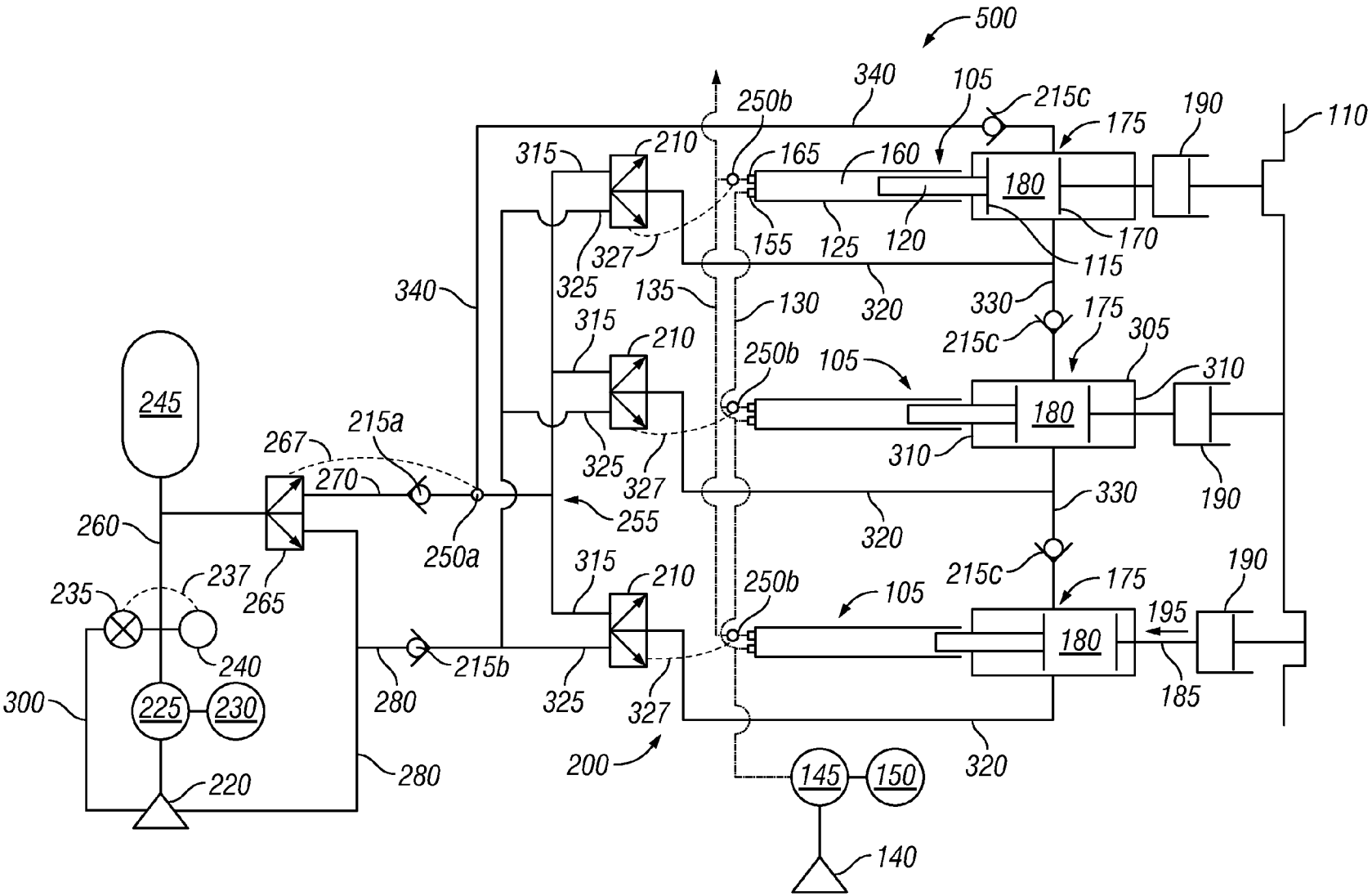
FIG. 2 is a schematic representation of another embodiment of a reciprocating pump system having a hydraulic control system, wherein the variable-volume chambers within the piston-cylinder assemblies are fluidicly coupled.
Figure 3:
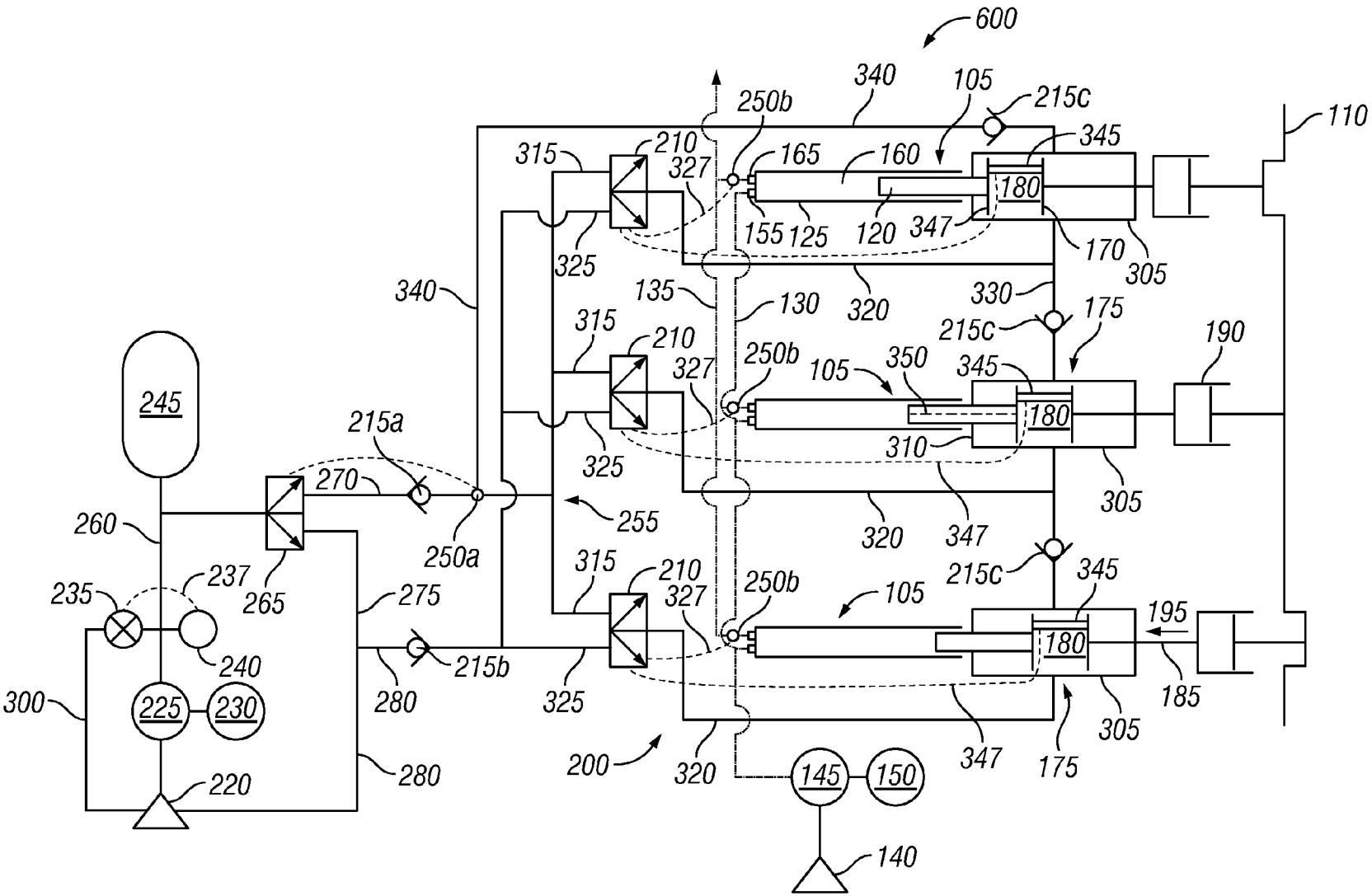
FIG. 3 is a schematic representation of still another embodiment of a reciprocating pump system with a hydraulic control system, wherein the volume of each variable-volume chamber is maintained substantially constant.

Gauge 240 is operable to sense the pressure of hydraulic fluid 180 in flowline 260. The sensed pressure is then communicated to relief valve 235 by an electrical line 237. For clarity, all electrical lines, including line 237, in FIGS. 1, 2 and 3 are represented by dashed lines, whereas all flowlines, piping segments, or manifolds through which hydraulic fluid and drilling mud flows are represented by solid lines and lines having alternating dashes and dots, respectively. Referring still to FIG. 1, if the sensed pressure exceeds a pre-selected pressure setting, relief valve 235 is actuated to divert hydraulic fluid 180 from flowline 260 into a bypass flowline 300. The diverted hydraulic fluid 180 is then returned through flowline 300 to hydraulic fluid source 220. Diverting hydraulic fluid 180 from flowline 260 into bypass flowline 300 in this manner prevents overpressuring of flowline 260 beyond the pre-selected pressure setting.

Two additional flowlines 270, 275 are coupled to PPC valve 265. As will be described, PPC valve 265 is actuatable to deliver hydraulic fluid 180 received by the valve into either flowline 270 or flowline 275. Flowline 270 delivers hydraulic fluid 180 from PPC valve 265 to hydraulic cylinders 305. A pressure sensor 250*a* and a one-way check valve 215*a* are disposed on flowline 270. Sensor 250*a* is operable to sense the pressure of hydraulic fluid 180 in flowline 270. The sensed pressure is then communicated to PPC valve 265 via an electrical line 267. Check valve 215*a* enables the flow of hydraulic fluid 180 therethrough in one direction only. In this embodiment, the flow of hydraulic fluid 180 through check valve 215*a* is permitted in a direction from PPC valve 265 toward hydraulic cylinders 305.

Flowline 275 diverts hydraulic fluid 180 from PPC valve 265 toward hydraulic fluid source 220, bypassing flowline 270. Flowline 275 is fluidicly coupled with flowline 280, which receives hydraulic fluid 180 relieved from piping network 255 and returns that fluid to hydraulic fluid source 220. A one-way check valve 215*b* is disposed on flowline 280 upstream of its connection to flowline 275. Check valve 215*b* enables the flow of hydraulic fluid 180 therethrough in one direction only. In this embodiment, the flow of hydraulic fluid 180 through check valve 215*b* is permitted in a direction from hydraulic cylinders 305 toward hydraulic fluid source 220. Thus, hydraulic fluid 180 diverted into flowline 275 is prevented by check valve 215*b* from flowing through flowline 280 toward hydraulic cylinders 305.

PPC valve 265 is configured such that when the pressure sensed by sensor 250*a* exceeds a pre-selected pressure setting, PPC valve 265 is actuated to divert hydraulic fluid 180 received from flowline 260 into flowline 275. Due to the presence of check valve 215*b* on flowline 280, the diverted hydraulic fluid 180 then returns to hydraulic fluid source 220. The divertion of hydraulic fluid 180 in this manner enables overpressuring of piping network 255 beyond the pre-selected pressure setting.

PPC valve 265 is further configured to divert hydraulic fluid 180 received from flowline 260 into flowline 270 when the pressure sensed by sensor 250*a* is less than the pre-selected pressure setting. This enables pressurization of piping network 255 between PPC valve 265 and hydraulic cylinders 305 to substantially the pre-selected pressure setting. Due to the presence of a one-way check valve 215*a* on flowline 270, no back flow, or reverse flow, of hydraulic fluid 180 having passed through check valve 215*a* is permitted within flowline 270.

As described, PPC valve 265 is configured to maintain the pressure of hydraulic fluid 180 in piping network 255 at substantially the pre-selected pressure setting. In some embodiments, the pre-selected pressure setting may correspond to or be a function of a desired or predetermined pressure for drilling mud within discharge manifold 135. The pressure of drilling mud in discharge manifold 135 is the discharge pressure of reciprocating pump system 100.

Each pair of opposing pistons 115, 170 is reciprocatingly disposed within one hydraulic cylinder 305. Hydraulic cylinder 305 has two opposing ends 310 through which plunger 120 and connecting rod 185 extend. Variable-volume chamber 175 is bounded by pistons 115, 170 and hydraulic cylinder 305. Pistons 115, 170 sealingly engage the interior surface of hydraulic cylinder 305 to prevent the loss hydraulic fluid 180 from variable-volume chamber 175 at these interfaces.

Flowline 270 is fluidicly coupled to, or in fluid communication with, variable-volume chambers 175 via flowlines 315, 320. Hydraulic fluid 180 is delivered by pump 225 through flowline 260, PPC valve 265, flowlines 315, and flowlines 320 into each variable-volume chamber 175. The influx of hydraulic fluid 180 to each variable-volume chamber 175 causes the associated plunger 120 to stroke out and chamber 175 to expand when the force of hydraulic fluid 180 acting on piston 115 exceeds or overcomes the force exerted by drilling mud within the associated compression chamber 160 acting on piston 115. As plunger 120 strokes out, the pressure of drilling mud within compression chamber 160 of piston-cylinder assembly 105 increases.

Further, flowline 280 is fluidicly coupled to variable-volume chambers 175 via flowlines 320, 325. Hydraulic fluid 180 within each variable-volume chamber 175 is relieved therefrom via flowlines 320, 325 and returned to hydraulic fluid source 220 via flowline 280. The outflow of hydraulic fluid 180 from each variable-volume chamber 175 allows the associated plunger 120 to stroke back and chamber 175 to contract when the force of drilling mud in compression chamber 160 acting on piston 115 exceeds the force of hydraulic fluid 180 acting on piston 115. As plunger 120 strokes back, the pressure of drilling mud within compression chamber 160 decreases.

A PPC valve 210 is disposed at each junction between flowlines 315, 320, 325. Further, a pressure sensor 250*b* is disposed downstream of the discharge valve 165 of each piston-cylinder assembly 105. Each sensor 250*b* is operable to sense the pressure of drilling mud exhausted from its associated piston-cylinder assembly 105. The sensed pressure is then communicated to the PPC valve 210 upstream of the piston-cylinder assembly 105, meaning the PPC valve 210 that is fluidicly coupled by flowline 320 to the variable-volume chamber 175 adjacent the piston-cylinder assembly 105, via an electrical line 327.

Each PPC valve 210 is actuatable to enable the flow of hydraulic fluid 180 from flowline 315 into flowline 320 when the pressure sensed by its associated sensor 250*b* is less than a pre-selected pressure setting, and to release hydraulic fluid 180 from flowline 320 into flowline 325 when the pressure sensed by the sensor 250*b* exceeds the pre-selected pressure setting. In this manner, PPC valve 210 controls the volume of hydraulic fluid 180 within its associated variable-volume chamber 175 and enables adjustment of that volume so as to maintain the discharge pressure of drilling mud exhausted from the associated piston-cylinder assembly 105 substantially at the pre-selected pressure setting. In some embodiments, the pre-selected valve is equal to or a function of a desired or predetermined discharge pressure for drilling mud exhausted by the piston-cylinder assembly 105. Furthermore, in some embodiments, the pre-selected pressure setting of each PPC valve 210 is substantially the same, and is less than that of PPC valve 265, preferably by at least 100 psi.

During operation of reciprocating pump system 100, each plunger 120 reciprocates within its associated cylinder 125. When a plunger 120 strokes out, as illustrated by plunger 120 in the uppermost piston-cylinder assembly 105 in FIG. 1, the discharge pressure of drilling mud exhausted by the associated piston-cylinder assembly 105 may exceed a desired or predetermined level, that level being equal to the pre-selected pressure setting. In the event that the discharge pressure, as sensed by sensor 250*b*, exceeds the pre-selected pressure setting, PPC valve 210 is actuated to relieve hydraulic fluid 180 from flowline 320. The reduction in hydraulic fluid 180 within flowline 320 enables a reduction in pressure acting on piston 115 and, in turn, a reduction in the discharge pressure. Thus, PPC valve 210 acts to bring the discharge pressure of piston-cylinder assembly 105 down to the desired level.

Similarly, when the plunger 120 strokes back, as illustrated by plunger 120 in the lowermost piston-cylinder assembly 105 of FIG. 1, the discharge pressure of drilling mud exhausted by the associated piston-cylinder assembly 105 may fall below the desired level. In the event that the discharge pressure, as sensed by sensor 250*b*, falls below the pre-selected pressure setting, PPC valve 210 is actuated to introduce hydraulic fluid 180 from flowline 315 into flowline 320. The increase in hydraulic fluid 180 within flowline 320 enables an increase in pressure acting on piston 115 and, in turn, an increase in the discharge pressure. Thus, PPC valve 210 acts to bring the discharge pressure of piston-cylinder assembly 105 up to the desired level.

In this manner, each PPC valve 210 maintains the discharge pressure of its associated piston-cylinder assembly 105 at the desired level. Moreover, the discharge pressure is maintained substantially constant despite changes in the position of plunger 120 within the piston-cylinder assembly 105 as plunger 120 reciprocates. Furthermore, while plunger 120 does reciprocate within cylinder 125, its stroke is reduced as compared to its counterpart in a conventional reciprocating pump having no hydraulic control system 200, which would reciprocate identically to piston 170. As a result, pressure pulsations created within the pressurized drilling mud due to contact between the drilling mud and plunger 120 are reduced. At the same time, PPC valve 265 adds and relieves hydraulic fluid 180 to and from, respectively, piping network 255 when necessary to maintain the volume of hydraulic fluid 180 in variable-volume chambers 175, which, in turn, enables maintenance of the discharge pressure of each piston-cylinder assembly 105.

Still further, the discharge pressure of each piston-cylinder assembly 105, and thus reciprocating pump system 100, is maintained without any adjustment to the stroke of piston 170, or to crankshaft 110. Hence, hydraulic control system 200 may be coupled to any conventional reciprocating triplex pump without the need to for modifications to the stroke of pistons 170 or crankshaft 110. Moreover, although hydraulic control system 200 is presented in the context of a mechanically driven, reciprocating triplex pump system 100, one having ordinary skill in the art will readily appreciate that hydraulic control system 200 may be modified for application to a reciprocating pump having fewer or greater than three piston-cylinder assemblies and/or to a reciprocating pump that is driven by means other than a rotating crankshaft, whether mechanical in nature or not.

Turning now to FIG. 2, there is shown another reciprocating pump system 500 in accordance with the principles disclosed herein for pressurizing a working fluid, such as but not limited to drilling mud. Reciprocating pump system 500 is substantially the same as reciprocating pump system 100 previously described but for the addition of flowlines 330, 340 and a one-way check valve 215*c* disposed on each. Variable-volume chambers 175 are fluidicly coupled to each other via flowlines 330. One-way check valve 215*c* disposed on each flowline 330 limits fluid flow therebetween to only one direction. In this embodiment, hydraulic fluid 180 is permitted to flow between adjacent variable-volume chambers 175 only in a direction toward flowline 340. This promotes maintenance of the pressure of hydraulic fluid 180 within each variable-volume chamber 175, and thus the discharge pressure of each piston-cylinder assembly 105, at the same level and, in turn, reduces pressure fluctuations in discharge manifold 130 due to differences in the discharge pressure of each piston-cylinder assembly 105.

Further, in the embodiment of FIG. 2, variable-volume chambers 175 are fluidicly coupled to flowline 270 via flowline 340. This enables the pressure sensed by sensor 250*a* and used by PPC valve 265 to control the addition of hydraulic fluid 180 to, or release of hydraulic fluid 180 from, piping system 255 to be substantially equal to the uniform discharge pressures of piston-cylinder assemblies 105. As such, hydraulic fluid 180 is introduced or vented from piping system 255 when necessary to maintain the discharge pressure.

Referring next to FIG. 3, there is shown still another reciprocating pump system 600 in accordance with the principles disclosed herein for pressurizing a working fluid, such as but not limited to drilling mud. Reciprocating pump system 600 is substantially the same as reciprocating pump system 500 previously described but for the addition of a linear displacement transducer 345 coupled between each pair of opposing pistons 115, 170. Linear displacement transducer 345 senses or monitors the relative axial position of pistons 115, 170, wherein the axial direction is parallel to a longitudinal axis 350 of hydraulic cylinder 305. In the embodiment of FIG. 3, transducers 345 may be those manufactured by Novotechnik U.S., Inc., headquartered at 155 Northboro Road, Southborough, Mass. 01772, such as transducers having model number TIM 0200 302 821 201. Alternatively, one or more transducers 345 may be manufactured by MTS Systems Corporation, headquartered at 14000 Technology Drive, Eden Prairie, Minn. 55344 and having model number GT2S 200M D60 1A0. Transducer 345 is also electrically coupled with the associated PPC valve 210 via an electrical line 347 and operable to adjust the pressure setting of PPC valve 210.

As previously described, depending upon its pressure setting, PPC valve 210 is actuated to deliver hydraulic fluid 180 into or relieve hydraulic fluid 180 from variable-volume chamber 175 via flowline 320.

Transducer 345 is preferably operable to adjust the pressure setting of PPC valve 210 to increase or decrease the volume of hydraulic fluid 180 within variable-volume chamber 175 such that the axial position of piston 115 relative to that of piston 170, and thus the volume of chamber 175, is maintained substantially constant and at a pre-selected value. The pre-selected value may correspond to a relative position of pistons 115, 170 at which drilling mud received within cylinder 120 is pressurized to a desired or predetermined discharge pressure. Moreover, the pre-selected value may correspond to plunger 120 being in a fully stroked out position, fully stroked back position, or another position therebetween.

By maintaining the relative position of pistons 115, 170 substantially constant despite the reciprocating motion of piston 170, the size of variable-volume chamber 175 also remains substantially constant and piston 115 reciprocates in unison with piston 170. Moreover, because piston 115 reciprocates in unison with piston 170, no cyclic forces are imparted to drilling mud within compression chamber 160 from contact between plunger 120 and the drilling mud due to displacement of piston 115, and therefore plunger 120, relative to piston 170. This enables further reduction in pressure pulsations created in the drilling mud during pressurization by reciprocating pump system 100.

Figure 4A:
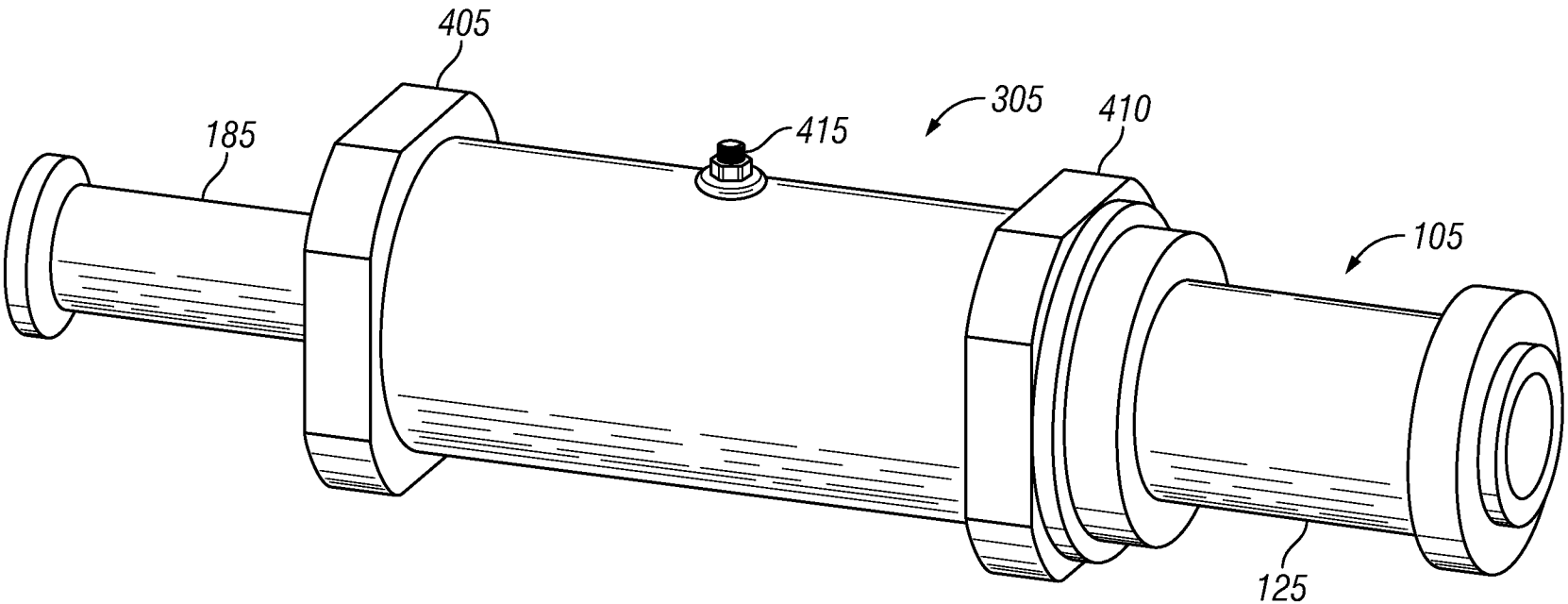
FIGS. 4A and 4B are perspective and cross-sectional views, respectively, of an embodiment of a hydraulic cylinder as may be employed within the embodiments of FIGS. 1-3.
Figure 4B:
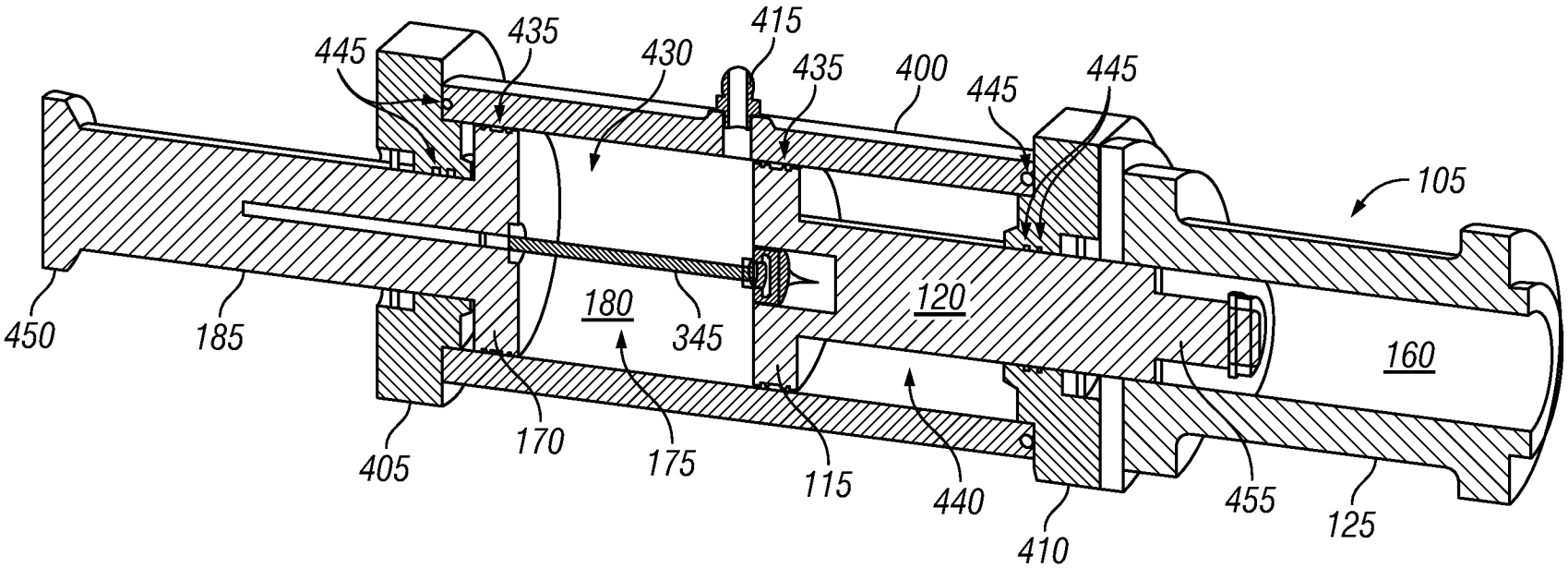

FIGS. 4A and 4B depict perspective and cross-sectional views, respectively, of an embodiment of a hydraulic cylinder 305 for use in reciprocating pump system 600 of FIG. 3. Beginning with FIG. 4A, hydraulic cylinder 305 is coupled between piston cylinder assembly 105 and connecting rod 185, both previously described. Hydraulic cylinder 305 includes a tubular section 400 disposed between two flanges 405, 410. Flanges 405, 410 enable mounting of tubular section 400 thereon and of hydraulic cylinder 305 to other components of reciprocating pump system 600. Tubular section 400 includes a throughbore 440 and a hydraulic fluid port 415 to which flowline 320 (FIG. 1) is coupled.

Turning to FIG. 4B, one end 420 of connecting rod 185 is inserted through flange 405 into throughbore 440 of tubular section 400 and coupled to piston 170. Similarly, one end 425 of plunger 120 of piston cylinder assembly 105 is inserted through flange 410 into throughbore 440 of tubular section 400 and coupled to piston 115. Variable-volume chamber 175 is bounded by opposing pistons 115, 170 and the inner surface 430 of tubular section 400 of hydraulic cylinder 305. Hydraulic fluid 180 is injected into and relieved from variable-volume chamber 175 via hydraulic fluid port 415. In this embodiment, reciprocating pump system 600 further includes linear displacement transducer 345, previously described, coupled between pistons 115, 170.

The other end 450 of connecting rod 185 is coupled to crankshaft 110 (FIG. 1). Thus, connecting rod 185 is driven such that piston 170 reciprocates within hydraulic cylinder 305. The other end 455 of plunger 120 is disposed within chamber 160 of cylinder 125 of piston cylinder assembly 105. Due to the transfer of force from piston 170 through hydraulic fluid 180 in variable-volume chamber 175 to piston 115, plunger 120 translates within chamber 160 to compress drilling mud therein.

To prevent the loss of hydraulic fluid 180 from variable-volume chamber 175, hydraulic cylinder 305 further includes a plurality of annular sealing members 435 disposed about pistons 115, 170 in sealing engagement with inner surface 430. Also, to prevent the transfer of fluid to or from throughbore 440 of tubular section 400, hydraulic cylinder 305 further includes a plurality of annular sealing members 445 disposed between, moving right to left in FIG. 4B, plunger 120 and flange 410, flange 410 and tubular section 400, flange 405 and tubular section 400, and connecting rod 185 and flange 405. In some embodiments, one or more sealing members 435, 445 are O-rings.

Although described in the context of reciprocating pump system 600, hydraulic cylinders 305 may also be employed in either or both of reciprocating pump systems 100, 500 previously described. In such cases, linear displacement transducer 345 would not be disposed within hydraulic cylinder 305 to control the relative position of pistons 115, 170. Instead, systems 100, 500 would perform as described above with respect to FIGS. 1 and 2, respectively.

While various embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A system for pressurizing a working fluid, the system comprising:

a cylinder having an outlet through which the working fluid is exhausted at a discharge pressure;

a plunger translatably disposed within the cylinder, the plunger having a first piston coupled thereto;

a second piston disposed opposite the first piston, the second piston driven to reciprocate;

a variable-volume chamber disposed between the first and second pistons, the variable-volume chamber substantially filled with a volume of hydraulic fluid; and a hydraulic system operable to increase and decrease the volume of hydraulic fluid within the variable-volume chamber at any time during reciprocation of the second piston, whereby the discharge pressure is maintained substantially at a predetermined level.

2. The system of claim 1, wherein the cylinder further comprises an inlet through which the working fluid flows.

3. The system of claim 1, wherein the first piston and the second piston are disposed in sealing engagement within a hydraulic cylinder.

4. The system of claim 1, wherein the second piston is mechanically driven.

5. The system of claim 4, wherein the second piston is driven by a rotating crankshaft.

6. The system of claim 1, wherein the hydraulic system further comprises a first control valve fluidicly coupled to the variable-volume chamber, the control valve actuatable to adjust the volume of hydraulic fluid within the variable-volume chamber.

7. The system of claim 6, wherein the hydraulic system further comprises a first sensor operable to measure the discharge pressure and wherein the first control valve is actuatable dependent upon the discharge pressure measured by the first sensor.

8. The system of claim 7, further comprising:

a source of hydraulic fluid;

a second control valve fluidicly coupled to the source of hydraulic fluid;

a piping network coupled between the first control valve and the second control valve;

wherein the second control valve is operable to inject hydraulic fluid into the piping network and to relieve hydraulic fluid from the piping network.

9. The system of claim 8, further comprising a second sensor operable to measure a pressure of hydraulic fluid within the piping network and wherein the second control valve is actuatable dependent upon the pressure of hydraulic fluid within the piping network measured by the second sensor.

10. A system for pressurizing a working fluid, the system comprising:

a first piston-cylinder assembly having:

a cylinder having an outlet through which the working fluid is exhausted at a discharge pressure;

two opposing pistons; and a variable-volume chamber disposed between the opposing pistons, the variable-volume chamber substantially filled with hydraulic fluid; and a first control valve fluidicly coupled to the variable-volume chamber, the first control valve actuatable to relieve hydraulic fluid from the variable-volume chamber when the discharge pressure exceeds a first pre-selected pressure and to enable delivery of hydraulic fluid to the variable-volume chamber when the discharge pressure is less than the first pre-selected pressure.

11. The system of claim 10, wherein one of the opposing pistons is displaceable by changes in a volume of hydraulic fluid contained within the variable-volume chamber and the other of the opposing pistons is driven to reciprocate.

12. The system of claim 11, wherein one of the opposing pistons is coupled to a plunger translatably disposed within the cylinder.

13. The system of claim 10, further comprising a first sensor operable to measure the discharge pressure and wherein the first control valve is actuatable dependent upon the discharge pressure measured by the first sensor.

14. The system of claim 10, further comprising:

a second piston-cylinder assembly substantially identical to the first piston-cylinder assembly;

a second control valve fluidicly coupled to the variable-volume chamber of the second piston-cylinder assembly, the second control valve actuatable to relieve hydraulic fluid from the variable-volume chamber of the second piston-cylinder assembly when the discharge pressure of the second piston-cylinder assembly exceeds a second pre-selected pressure and to enable delivery of hydraulic fluid to the variable-volume chamber when the discharge pressure is less than the second pre-selected pressure; and a flowline fluidicly coupling the variable-volume chambers, whereby pressure of hydraulic fluid within each variable-volume chamber is substantially the same.

15. The system of claim 14, further comprising a one-way check valve disposed on the flowline and operable to limit flow of hydraulic fluid therethrough in only one direction.

16. The system of claim 14, the discharge pressures of the first and the second piston-cylinder assemblies are substantially equal.

* * * * *